US005113758A

United States Patent [19]

Chou

[11] Patent Number: 5,113,758

[45] Date of Patent: May 19, 1992

[54] TICKET DISPENSER

[75] Inventor: Long-Shou Chou, Taipei, Taiwan

[73] Assignee: Entropy International Co., Ltd., Taipei, Taiwan

[21] Appl. No.: 663,013

[22] Filed: Mar. 1, 1991

[51] Int. Cl.[5] ..... B41L 15/02

[52] U.S. Cl. ..... 101/66; 226/144; 226/156; 226/188; 101/316

[58] Field of Search ..... 226/134, 135, 144, 145, 226/156, 186, 187, 188; 225/12, 14, 16; 221/71, 74, 277; 101/292, 316, 66

[56] References Cited

U.S. PATENT DOCUMENTS

| | | | |
|---|---|---|---|
| 3,782,616 | 1/1974 | Surber, Jr. | 226/135 |
| 3,840,164 | 10/1974 | Takenaka et al. | 226/187 |
| 4,086,833 | 5/1978 | Austin, Jr. | 226/134 |
| 4,272,001 | 6/1981 | Horniak | 226/12 |
| 4,579,269 | 4/1986 | Lasley | 226/144 |

*Primary Examiner*—Edgar S. Burr
*Assistant Examiner*—Christopher A. Bennett
*Attorney, Agent, or Firm*—Bacon & Thomas

[57] ABSTRACT

A ticket dispenser capable of effectively preventing additionally withdrawing thereout a ticket is provided. The dispenser includes two side plates inclinedly mounting therebetween two guide plates feeding therebetween a ticket strip, a first shaft securing thereto an active roller and a worm gear meshing with a worm parallelly and axially slidably held attached to one side plate, a belt mounted between a motor spindle and a belt wheel unrotatably but slidably fixed to one end of the worm, a second shaft securing thereto a ratchet wheel and a passive roller cooperating with the active roller to clamp therebetween and controlledly feed therethrough the ticket strip, and a stopper pivotally connected to the one side plate and having a top pawl end and a bottom end connected to the worm in a manner that when one attempts to illegally pull said ticket strip out of said dispenser, said worm gear will tend to translate said worm to the direction of right and causing said stopper engaging with said ratchet and firmly stop said passive roller from rotating by the illegally pull force of the ticket strip, and said active roller will be stopped together with said worm since the worm is limitedly slidably held attached to the one side plate.

5 Claims, 5 Drawing Sheets

TICKET DISPENSER

BACKGROUND OF THE INVENTION

The present invention relates to a ticket dispenser, and more particularly to one capable of effectively preventing a ticket from being additionally withdrawn therefrom.

The ticket dispenser is extensively used in a large playground or a recreation ground since it will dispense the ticket if one or more suitable coins(s) is (are) inserted therein to switch on the ticket transmitting mechanism therein. In order to prevent the ticket in the dispenser from being additionally withdrawn therefrom, some improved ticket dispenser, e.g. U.S. Pat. No. 4,272,001 is proposed. The present invention tires in a manner to more effectively prevent the ticket in the dispenser from being illegally withdrawn therefrom.

SUMMARY OF THE INVENTION

It is therefore an object of the present invention to additionally provide a ticket dispenser capable of more effectively preventing the ticket therein from being illegally pulled out of the dispenser.

According to the present invention, a ticket dispenser includes two parallel side plates inclindedly mounting therebetween two guide plates feeding therebetween a ticket strip, a first shaft securing thereto an active roller and a worm gear meshing with a worm parallelly and axially slidably held attached to one side plate, a belt mounted between a motor spindle and a belt wheel unrotatably but slidably fixed to one end of the worm, a second shaft securing thereto a ratchet wheel and a passive roller cooperating with the active roller to clamp therebetween and controlledly feed therethrough the ticket strip, and a stopper pivotally fixed to the one side plate and having a top pawl end and a bottom end connected to the worm in a manner that when one attempts to illegally pull the ticket strip out of the dispenser, the worm gear will tend to translate the worm to so additionally prevent the active roller from being undersignedly rotated since the worm is limitedly slidably held attached to the one side plate.

The present invention may best be understood through the following description with reference to the accompanying drawings, in which:

DETAILED DESCRIPTION OF THE PREFERRED EMBODIMENT

Figure 1:
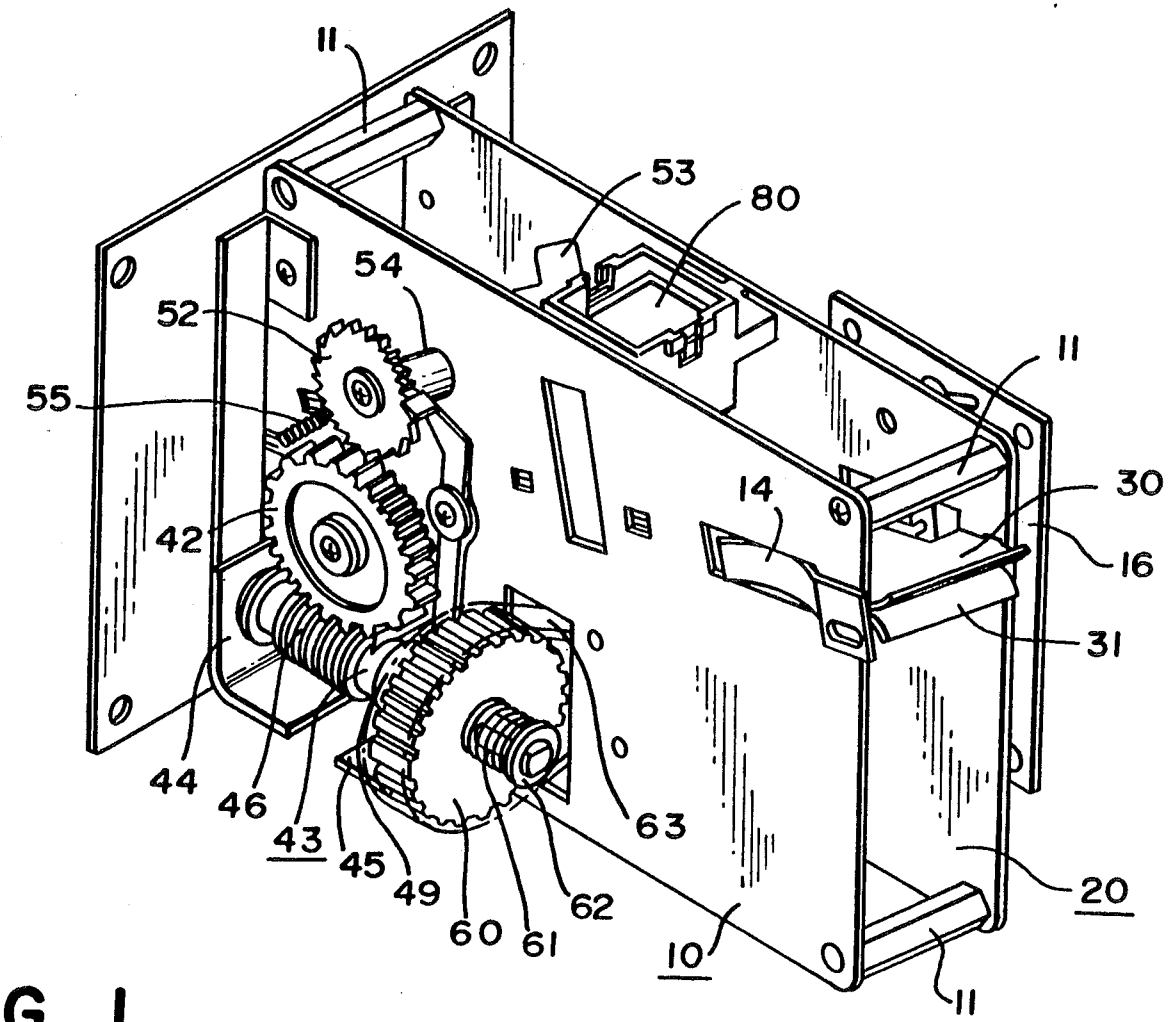
FIG. 1 is a perspective view showing a preferred embodiment of a ticket dispenser according to the present invention.
Figure 2:
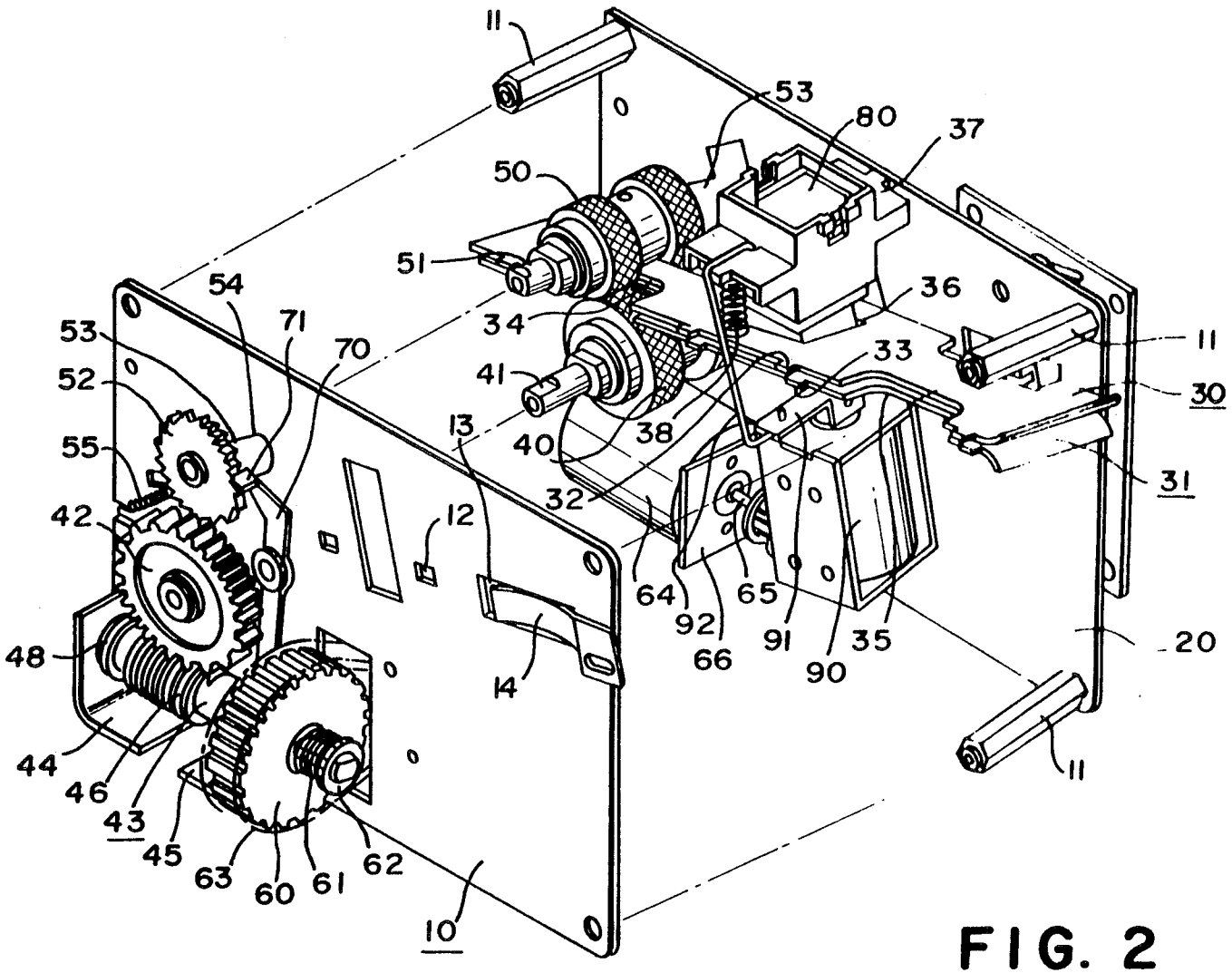
FIG. 2 is an exploded view showing a ticket dispenser in FIG. 1.
Figure 3:
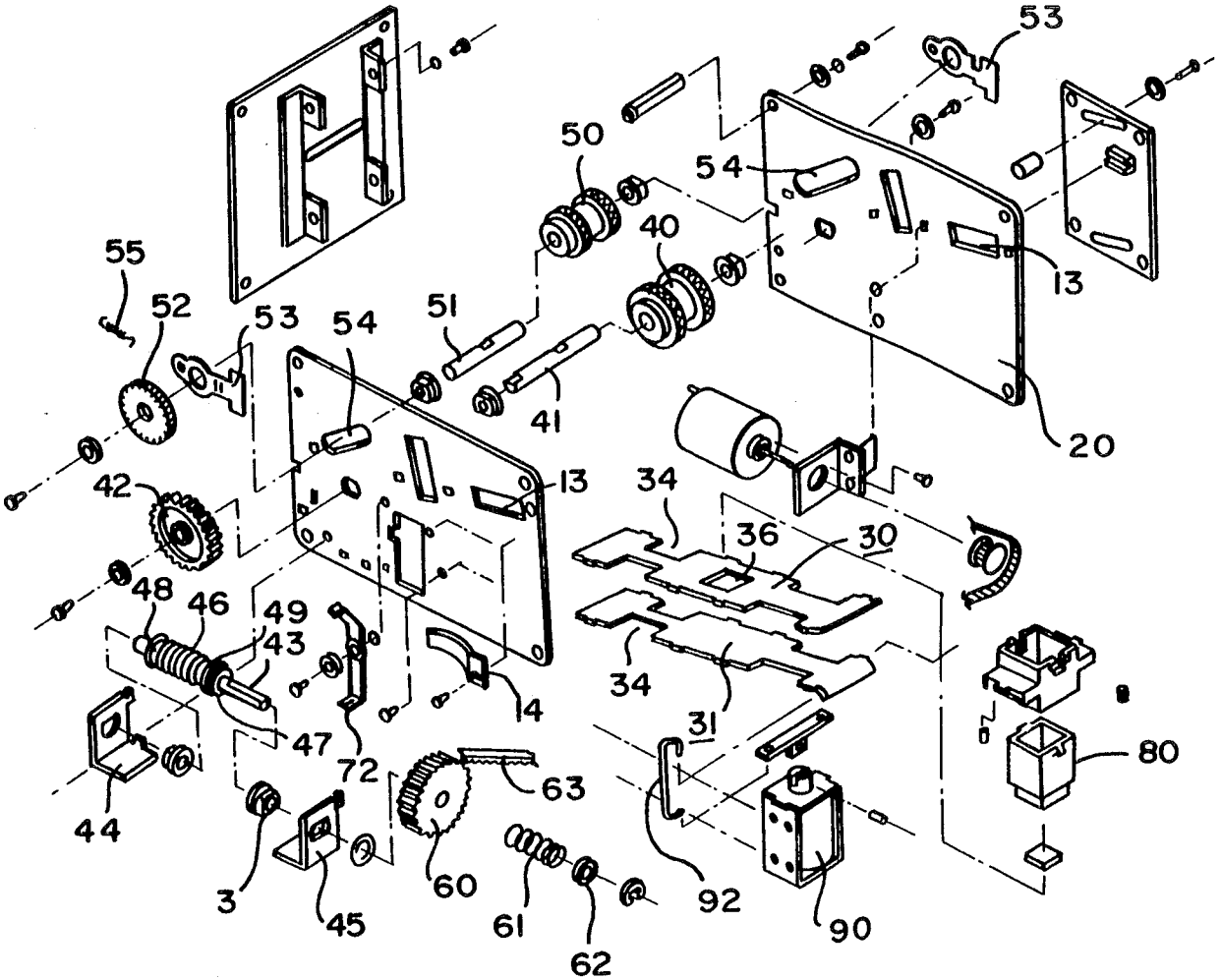
FIG. 3 is a detailedly exploded view showing a ticket dispenser in FIG. 1.
Figure 5:
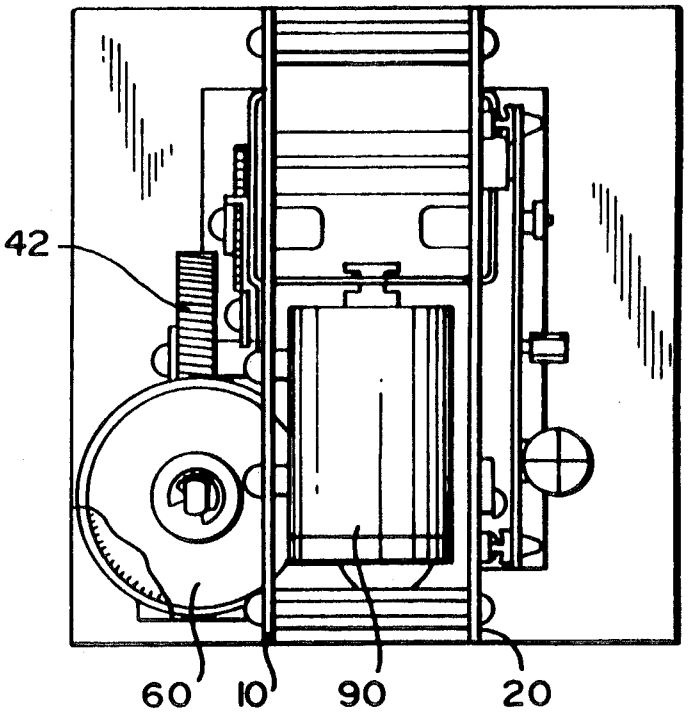
FIG. 5 is an end view of a ticket dispenser in FIG. 1.
Figure 4:
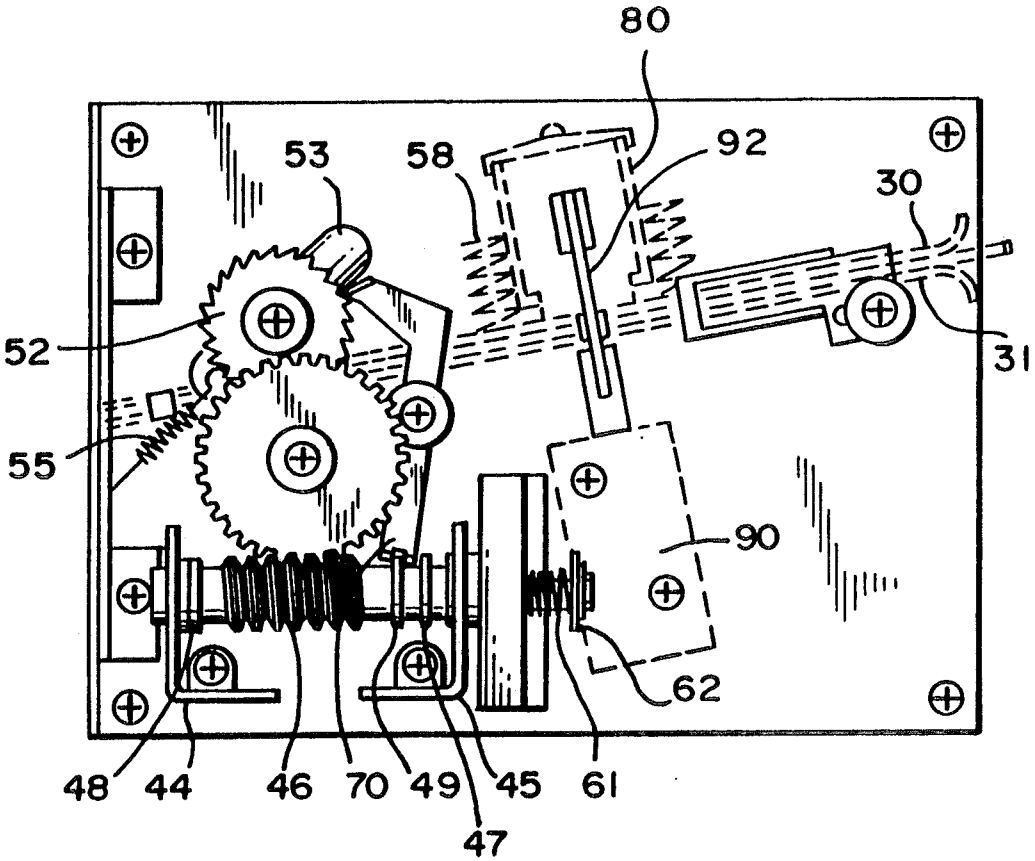
FIG. 4 is a side view of a ticket dispenser in FIG. 1.
Figure 6:
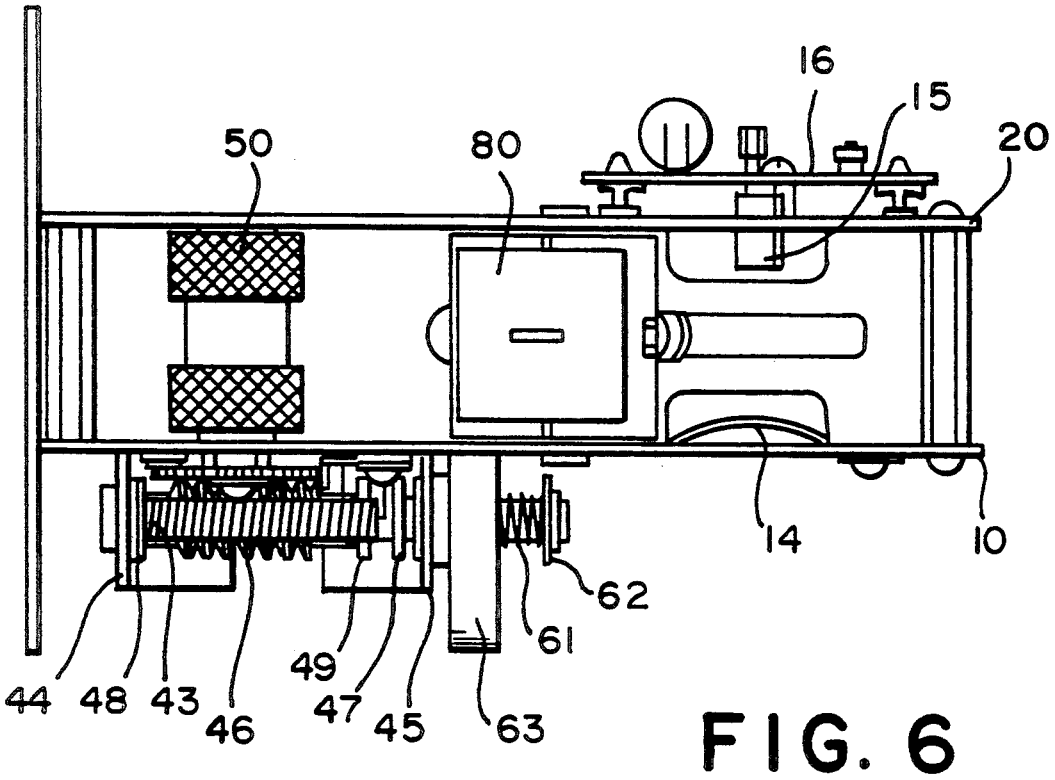
FIG. 6 is a top view of a ticket dispenser in FIG. 1.
Figure 7:
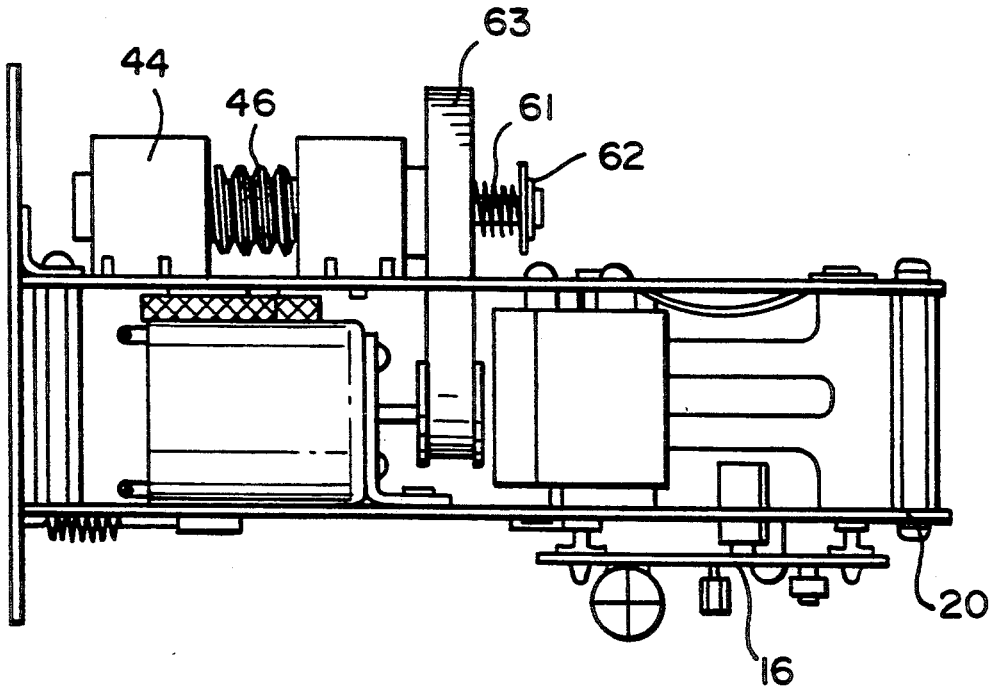
FIG. 7 is a bottom view of a ticket dispenser in FIG. 1.

Referring now to FIGS. 1-7, two side frame plates 10, 20 of a ticket dispenser according to the present invention are parallelly spaced by spacing posts 11 and inclindedly mount therebetween two opposite guide plates 30, 31 respectively having side projections 32, 33 respectively projecting into corresponding holes 12 provided on plates 10, 20 so that guide plates 30, 31 can guide therebetween a ticket strip of a variable thickness. Guide plates 30, 31 include front side recesses 34, and rear side recess 35 which respectively protrude therein a supporter 15 fixing thereto a sensing pronted circuit board 16 and a curve elastic member 14 projecting form a groove 13 of side plate 10 (as shown in FIG. 6).

A first shaft 41 rotatably mounted on side plates 10, 20 secures thereto a centrally grooved knurled active roller 40 and a worm gear 42 meshing with a worm 43 axially slidably and rotatably mounted on two spaced angle pieces 44, 45 held attached to side plate 10 thus parallel to worm 43 which includes a thread 46 having a predetermined spiral angle of e.g. 5 degrees, two stopping pieces 47, 48 capable of respectively stopping against angle pieces 45, 44, a coaxial ring 49 disposed adjacent to stopping piece 47, a belt wheel 60 coaxially slidably fixed thereto, an 20 end washer 62, and a spring 61 mounted between belt wheel 60 and washer for always leftwardly urging wheel 60. Certainly, the left end of worm 43 can be provided with balls for contacting with an anti-abrasive plate attached to angle piece 44 so that stopping piece 48 can be dispensed with.

A second shaft 51 rotatably mounted in two opposite sloping grooves 54 of side plates 10, 20 includes a centrally grooved knurled passive roller 50 oppositely facing with active roller 40 through front side recesses 34 to feed therebetween the ticket strip, a ratchet wheel 52, two connectors 53 sleeved thereon, and two springs 55 respectively mounted between side plates 10, 0 and connectors 53 for always downwardly urging roller 50 toward roller 40.

A belt 63 is mounted between belt wheel 60 and the spindle 65 of a motor 64 fixed to supporting plate 66 fixed to side plate 20. A stopper 70 is intermediately pivotally fixed to side plate 10 and has a top pawl end 71 capable of engaging with ratchet wheel 52 and a bottom end having an indentation 72 matching therein a segment of ring 49.

A stamper 80 includes a bottom stamping surface capable of passing through a hole 36 of guide plate 30, and two wings 37 connected by a link 92 to a connecting piece 91 for an electromagnetic device 90 disposed under guide plate 31. Two springs 38 are respectively mounted between wings 37 and guide plate 30.

The operations of the present ticket dispenser are as follows:

The ticket strip is inserted into the space defined between guide plates 30, 31 to be fed by rollers 40, 50 out of the present dispenser. Since shaft 51 is urged against by springs 44, rollers 40, 50 can tightly clamp therebetween the ticket strip no matter what the thickness of the ticket strip may be. When one or more suitable coin(s) is (are) inserted into the present ticket dispenser to energize motor 64, belt 63 will tend to rotate worm gear 42 and active roller 40. Since spring 61 rightwardly urges worm 43 having so that top pawl end 71 always tends to engage with ratchet wheel 52 and to prevent passive roller 50 tightly urging against active roller 40 through the ticket strip from being rotated, worm 43 thus first leftwardly rotatingly slides until top pawl end 71 disengages from ratchet wheel 42. Then, rotating belt wheel 60 or worm 43 can rotate ratchet wheel 42 or rollers 40 and 50 to feed therethrough the ticket strip. When the preset time period during which the motor 64 should be energized is reached belt wheel 60 or worm 43 stops rotating. If one now attempts to illegally pull the ticket strip out of the dispenser, worm gear 42 will rightwardly translate worm 43 to engage top pawl end again with ratchet wheel 52 which makes it more difficult to rotate roller 50 or rollers 50, 40 since in addition to the fact that top pawl end 71 engages with ratchet wheel 52, worm gear 42 rightwardly translating worm 43 can no more rotate when stopping piece 47 engages with angle piece 45. Furthermore, the force attempted to additionally withdraw a ticket from the present dispenser serve to safeguard the present dispenser since a force component of the attempted force will serve to more rightly urge roller 50 against roller 40 through the ticket strip since the attempted force will tend to leftwardly downwardly pull shaft 51 along grooves 54. Electromagnetic device 90 can be energized to enable through connecting piece 91 and link 92 stamper 80 to stamp a trademark, a data or a number on the ticket strip before it is fed out of the present ticket 20 dispenser when motor 64 is energized so that a ticket dispenser is diversified.

What is claimed is:

1. A ticket dispenser comprising:

two parallelly spaced side frame plates inclindedly mounting therebetween two opposite guide plates feeding therebetween a ticket strip;

a first shaft rotatably mounted on said side frame plates and securing thereto an active roller and a worm gear having a predetermined spiral-angle and a rotating axis perpendicular to said side plates;

a worm parallelly, spacedly and limitedly axially slidably held attached to one of said side plates, and meshing with said worm gear;

a motor having a spindle;

a belt wheel non-rotatably but slidably fixed to one end of said worm;

a belt mounted between said spindle and said belt wheel; a second shaft rotatably mounted on said side frame plates, and securing thereto a ratchet wheel and a passive roller cooperating with said active roller to clamp therebetween and controlledly feed therethrough said ticket strip;

a first elastic member mounted between said second shaft and said side frame plates for always urging said passive roller and said ticket strip against said active roller; and a stopper pivotally connected to said one said plate, and having a top pawl end capable of engaging with said ratchet wheel and a bottom end connected to said worm in a manner that when one attempts t illegally pull said ticket strip out of said dispenser, said worm gear will tend to translate said worm to the direction of right and causing said stopper engaging with said ratchet and firmly stop said passive roller from rotating by the illegally pull force of the ticket strip, and said active roller will be stopped together with said worm since the worm is limitedly slidably held attached to the one side plate.

2. A ticket dispenser according to claim 1, further comprising a second elastic member mounted between said one worm end and said belt wheel.

3. A ticket dispenser according to claim 1 wherein said worm includes thereon a coaxial ring and said bottom end has an indentation matching therein a segment of said ring.

4. A ticket dispenser according to claim 1 wherein said side plates respectively include two sloping elongate grooves mounting therein said second shaft for enabling said active and passive rollers to tightly clamp therebetween said ticket strip of a various thickness.

5. A ticket dispenser according to claim 1, further comprising:

a stamper generally mounted above said guide plates and between said side plates;

an elastic member mounted between said stamper and said guide plates; and an electromagnetic device mounted under said guide plates and capable of actuating said stamper to stamp on said ticket strip.

* * * * *